United States Patent [19]

Kretzschmar et al.

[11] Patent Number: 4,529,256

[45] Date of Patent: Jul. 16, 1985

[54] ELECTRICAL CONNECTOR

[75] Inventors: Wolfgang Kretzschmar; Peter E. Murray, both of Detmold, Fed. Rep. of Germany

[73] Assignee: C. A. Weidmüller GmbH, Detmold, Fed. Rep. of Germany

[21] Appl. No.: 445,267

[22] Filed: Nov. 29, 1982

[30] Foreign Application Priority Data

Nov. 26, 1981 [DE] Fed. Rep. of Germany ..... 3146913

[51] Int. Cl.[3] ..... H01R 31/08

[52] U.S. Cl. ..... 339/19; 339/201; 339/242

[58] Field of Search ..... 339/19, 200 R, 201, 339/222, 242, 244 R

[56] References Cited

U.S. PATENT DOCUMENTS

| | | | |
|---|---|---|---|
| 3,546,364 | 12/1970 | O'Neel | 339/242 |
| 3,585,566 | 6/1971 | Slevert | 339/242 |
| 3,740,692 | 6/1973 | Filhaber | 339/242 |
| 3,813,635 | 5/1974 | Cooper, Jr. et al. | 339/242 |
| 4,231,633 | 11/1980 | Luke et al. | 339/242 |

*Primary Examiner*—Gil Weidenfeld

*Assistant Examiner*—Paula A. Austin

*Attorney, Agent, or Firm*—Peter K. Kontler

[57] ABSTRACT

A connector for electrically connecting a row of electrical clamps with one another includes an electrically conductive connecting strip which is designed to span the clamps and to define gaps with the electrical contacts of the clamps. The connecting strip is of one piece with a plurality of bridging members which are designed to bridge the gaps between the connecting strip and the contacts of the clamps. The bridging members are L-shaped and include long legs which project from the connecting strip and short legs which extend from the long legs and are arranged to engage the contacts of the clamps. The short legs have openings which receive screws for connecting the short legs with the contacts. The heads of the screws are embraced by retaining sleeves which prevent displacement or loss of the screws. The retaining sleeves have openings to permit insertion of a screwdriver for tightening and loosening the screws. The diameters of these openings are smaller than the diameters of the heads of the screws. The retaining sleeves are of one piece with an insulating jacket which surrounds the connecting strip. The connector is simple to manufacture and assemble.

20 Claims, 2 Drawing Figures

ELECTRICAL CONNECTOR

BACKGROUND OF THE INVENTION

The invention relates generally to an electrical connector.

More particularly, the invention relates to a connector for electrically connecting a series of spaced electrical elements, e.g. a series of spaced electrical clamps, with one another.

A known connector for electrically connecting a series of spaced electrical clamps with one another includes an elongated, electrically conductive member which is designed to span the clamps with clearance. An array of electrically conductive bridging members is mounted on the elongated member. The bridging members are spaced in the longitudinal direction of the elongated member and are designed to bridge the gaps which exist between the clamps and the elongated member. In other words, the bridging members are designed to connect the clamps with the elongated member. Each of the bridging members carries a screw for effecting a connection with the respective clamp. The bridging members are of one piece with the elongated member and the junctions between the bridging members and the elongated member are weakened thereby permitting any bridging member which is not to be used to be broken off from the elongated member.

A prefabricated connector of the type outlined above is simpler to install than a connector which must be assembled at the time it is to be used. With a prefabricated connector, it is only necessary to position the connector on the clamps and to then thread the screws into corresponding threaded openings provided in the electrical contacts of the clamps. The bridging members corresponding to those clamps which are not to be subjected to the potential applied to the connector are broken off at the weakened junctions between such bridging members and the elongated member.

Each of the clamps has a cavity which is designed to receive the elongated member. In a connector disclosed in the German Offenlegungsschrift No. 23 57 052, the elongated member is constituted by a connecting strip which almost entirely fills the cavities in the clamps. The bridging members are suspended from the connecting strip and each of the bridging members is composed of two straps cooperating to define a sleeve which is interrupted or broken at two locations circumferentially thereof. The screws are inserted into the sleeves via openings in the connecting strip and the sleeves resiliently engage the screws to thereby hold and guide the same.

The connector of the German publication has a complicated shape which makes it difficult to manufacture using stamping and bending techniques. Furthermore, the screws must be relatively long since they must extend from the connecting strip to the contacts on the clamps. Moreover, certain precautions must be taken to insure that the sleeves continue to be biased towards the screws as the latter are threaded into the clamps, that is, to insure that the sleeves are not spread apart by the screws and thus lose the capability to perform their holding and guiding functions. Such precautions tend to further complicate the shape of the connector.

OBJECTS AND SUMMARY OF THE INVENTION

It is an object of the invention to provide an electrical connector which is simple to install.

Another object of the invention is to provide an electrical connector which is simple to manufacture.

An additional object of the invention is to provide an electrical connector which is capable of employing screws or other connecting members having a relatively long length.

It is also an object of the invention to provide an electrical connector of the type outlined above which is particularly easy to manufacture and install.

The preceding objects, as well as others which will become apparent as the description proceeds, are achieved by the invention.

One aspect of the invention resides in a connector for electrically connecting a series of electrical elements, e.g. a series of electrical clamps, with one another. The connector includes an elongated, electrically conductive member designed to span and define respective gaps with a plurality of spaced electrical elements which are to be electrically connected with one another. An electrically conductive bridging member is provided for each of the electrical elements and is designed to bridge the gap between the respective electrical element and the elongated member. The bridging members are spaced from each other in longitudinal direction of the elongated member. Each of the bridging members is substantially L-shaped and includes a first leg which projects from the elongated member and a second leg which extends from the first leg. The connector further comprises a connecting member for each of the second legs designed to connect the same with the respective electrical element.

The connecting members may be in the form of screws designed to be received in threaded openings formed in electrical contacts provided on the electrical elements.

The bridging members may be connected with the elongated member via weakened junctions so as to permit any bridging member which is not to be used to be broken off from the elongated member.

The first legs of the bridging members, that is, the legs which project from the elongated member, may be longer than the second legs. The first legs may project downwardly from the elongated member and the second legs may extend from the lower ends of the first legs.

In a preferred embodiment of the invention, a retaining member is provided for each screw to prevent displacement of the same from the respective second leg. A common mounting member may be provided for the retaining members and such mounting member may be located above the screws. The retaining members project downwardly from the mounting member to embrace at least the upper portions of the respective screws. The retaining members may be formed with openings which permit the screws to be tightened and loosened from externally of the retaining members.

The component constituted by the preferably metallic elongated member and the associated, substantially L-shaped bridging members is very simple to manufacture by means of stamping and bending techniques. This is particularly true since such component need not function to prevent displacement or loss of the screws. The component need merely be provided with apertures which permit passage of the screws therethrough. The retaining members which are placed over the screws serve to prevent loss or displacement of the same. By arranging the retaining members on a common mounting member, installation of the retaining members may be simplified considerably.

The screws are mounted on the transverse or second legs of the L-shaped bridging members. This makes it possible for the screws to have very short shanks. This arrangement also makes it possible to insure that synthetic plastic portions of the electrical elements or clamps to be connected with one another are not directly subjected to the forces exerted by the screws. Thus, the heads of the screws always press directly on the electrical contacts of the respective electrical elements or clamps via the short transverse or second legs of the L-shaped bridging members.

According to a particularly favorable embodiment of the invention, the elongated member is in the form of a thin strip which constitutes a grip for the connector and the mounting member provided for the retaining members comprises an insulating jacket which surrounds the strip. As mentioned previously, electrical clamps are generally formed with cavities designed to receive the elongated member of a connector. By making the elongated member of the invention in the form of a thin strip, the connector may be arranged so that only one side or portion of a cavity is occupied by the elongated member while the remainder of the cavity remains unoccupied. This makes it possible to install a second connector so that a series of electrical elements or clamps can be switched between two different potentials. The design of the mounting member as an insulating jacket for the thin metallic strip constituting the elongated member has the advantage that the mounting member performs a dual function, that is, serves to support the retaining members and serves as a reliable insulator for the metallic elongated member.

The assembly of the connector according to the invention is also very simple. This may be accomplished by depositing the screws, e.g. automatically, on the short transverse or second legs of the L-shaped bridging members. The elongated member and its bridging members together with the screws which have been deposited on the bridging members may then be readily inserted from below into the component constituted by the insulating jacket and the retaining members. The retaining members, which may also be composed of an insulating material, are positioned over the screws during the inserting operation.

As mentioned earlier, the retaining members may be provided with openings to permit tightening and loosening of the screws from externally of the retaining members. It is advantageous for these openings to be circular and to be located at the upper ends of the retaining members. This greatly simplifies manipulation of the screws.

The electrical clamps of a series are generally separated by dividing walls. In accordance with a favorable embodiment of the invention, the common mounting member for the retaining members is formed with a series of slots which are designed to receive and loosely clamp the dividing walls. This greatly simplifies installation of the connector when the latter is installed from above. The loose clamping effect insures that the connector does not fall unintentionally between the time that the connector is deposited on the electrical elements or clamps and the time that the first screw is tightened.

The novel features which are considered as characteristic of the invention are set forth in particular in the appended claims. The improved connector itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
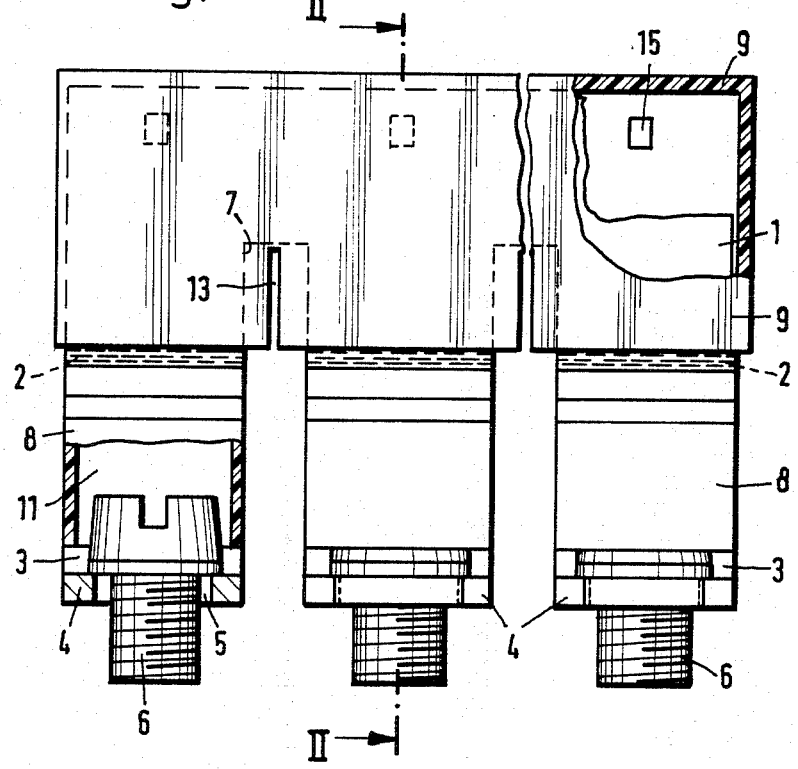
FIG. 1 is a partly cross-sectional elevational view illustrating an electrical connector in accordance with the invention.
Figure 2:
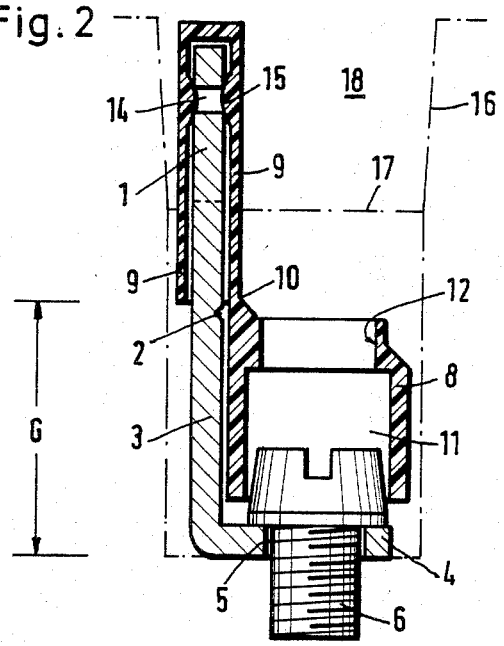
FIG. 2 is a cross-sectional view in the direction of the arrows II—II of FIG. 1.

FIGS. 1 and 2 illustrate a connector or cross connection link for electrically connecting a series or row of spaced electrical clamps 16 such as modular terminal blocks of which one is shown in phantom lines in FIG. 2. The connector includes a elongated, electrically conductive member in the form of a thin, metallic connecting strip 1 which spans the clamps 16. The clamps 16 have electrical contacts (current bars) which are spaced from the connecting strip 1 by gaps G. The connecting strip 1 functions to provide an electrical path joining the clamps 16. In addition, the connecting strip 1 functions as a grip for manipulating the connector.

A series of electrically conductive bridging members 3, 4 projects downwardly from the bottom of the connecting strip 1. The bridging members 3,4 are spaced in the longitudinal direction of the connecting strip 1 and one such bridging member 3,4 is provided for each of the clamps 16. The bridging members 3,4 bridge the gaps G between the connecting strip 1 and the contacts of the clamps 16.

As best seen in FIG. 2, the bridging members 3,4 are L-shaped and include first or long legs 3 which are of one piece with the connecting strip 1 and second or short legs 4 which extend from the lower ends of the long legs 3 transversely of the latter. The short legs 4 are designed to engage the contacts of the clamps 16. The long legs 3 are joined to the connecting strip 1 via notched or weakened junctions 2 so as to permit any bridging member 3,4 which is not to be used to be separated from the connecting strip 1.

The short legs 4 of the bridging members 3,4 are provided with apertures 5. The apertures 5 are designed to receive connecting members or screws 6 for connecting the lower legs 4 to the contacts of the clamps 16. The heads of the screws 6 bear against the upper surfaces of the short legs 4.

The arrangement according to the invention permits the screws 6 to be very short. The forces exerted by the screws 6 are transmitted directly from the heads of the screws 6 to the short legs 4 and then to the contacts of the clamps 16 which are situated immediately below the short legs 4. The forces exerted by the screws 6 do not tend to twist or otherwise deform the L-shaped bridging members 3,4. This is especially true when those areas of the short legs 4 which contact the heads of the screws 6 are substantially planar.

The arrangement in accordance with the invention further prevents the forces exerted by the screws 6 to be transmitted to neighboring synthetic plastic portions of the respective clamps 16. In this connection, it is important to insure that the connecting strip 1 does not contact the dividing walls which, as indicated previously, may be arranged between neighboring ones of the clamps 16. One such dividing wall is shown in phantom lines in FIG. 2 and is indentified by the reference numeral 17. Contact between the connecting strip 1 and the dividing walls 17 may be avoided by making the bridging members 3,4 of proper length and by forming recesses 7 of suitable height in the connecting strip 1 at the locations where the latter traverses the dividing walls 17.

In view of the difficulties which are normally encountered during installation of electrical connectors of the type under consideration, it is desirable for the screws 6 to be held in the transverse short legs 4 in such a manner that they cannot be displaced or lost. To this end, an insulating retaining member 8 is provided for each of the screws 6. The retaining members 8 are of one piece with a common, insulating mounting member in the form of a jacket 9. As most clearly seen in FIG. 2, the retaining members 8 are suspended from the jacket 9 in that an upper edge of each retaining member 8 merges into a lower edge of the jacket 9. The jacket 9 is designed such that it can receive the connecting strip 1 in its entirety. Thus, the metallic connecting strip 1 is shielded against contact.

The retaining members 8 are connected to the jacket 9 along junctions 10 which are so thin that they may be considered as weakened areas. Accordingly, it is not only possible to separate any desired bridging member 3,4 from the connecting strip 1 at the respective junction 2 but also to separate the corresponding retaining member 8 from the jacket 9 at the respective junction 10.

In the illustrated embodiment, the retaining members 8 are in the form of sleeves having essentially rectangular cross sections. The lower portions of the retaining members 8 have open bottom ends and define receiving spaces 11 of substantially rectangular cross section for the heads of the screws 6. The upper portions of the retaining members 8 are provided with openings 12 which communicate with the receiving spaces 11 and permit a screwdriver or the like to be inserted therein so as to tighten and loosen the screws 6. The openings 12 are circular and are dimensioned in such a manner that they are capable of serving as guides for a screwdriver or the like. Furthermore, the diameters of the openings 12 are such that the heads of the screws 6 cannot pass therethrough.

As best seen in FIG. 1, the jacket 9 which carries the retaining members 8 is provided with slots 13 for receiving the dividing walls 17 which separate neighboring ones of the clamps 16. The slots 13 are dimensioned in such a manner that they are capable of loosely clamping the upper portions of the dividing walls 17. Accordingly, when the connector is placed onto the array of clamps 16 and dividing walls 17 from above, the connector is gripped and thereby prevented from falling even though none of the screws 6 has yet been threaded into the contact of the corresponding clamp 16.

The connector is assembled by first inserting the screws 6 in the short transverse legs 4 of the bridging members 3,4. The metallic portion of the connector comprising the connecting strip 1 as well as the bridging members 3,4 and the screws 6 is then inserted in the one piece synthetic plastic portion of the connector including the jacket 9 and the retaining members 8. Upon completion of the inserting operation, the retaining members 8 embrace the heads of the screws 6 thereby preventing loss or displacement of the screws 6. It will be observed that assembly of the connector may be accomplished very simply.

In order to prevent displacement of the jacket 9 relative to the connecting strip 1, the latter is advantageously provided with a series of transverse passages 14 while corresponding locations of the inner surfaces of the jacket 9 are formed with protuberances 15 which snap into the passages 14 during assembly of the connector.

As shown in FIG. 2, the clamps 16 have cavities 18 for accommodating the connector. The connecting strip 1 and its jacket 9 occupy only one side of each of the cavities 18. The other side of each cavity 18 can accommodate the connecting strip 1 of a second connector according to the invention which is arranged such that the bridging members 3,4 of the two connectors are in mirror-image relationship to one another. By breaking off appropriate ones of the bridging members 3,4, the clamps 16 may then be brought to either of two different potentials. It is further possible to arrange the connecting strips 1 of two connectors according to the invention opposite one another in such a manner that a dual connection is formed between the clamps 16 with each of the latter being joined to both connectors. Such a dual connection may, for example, be subjected to the full rated current of the clamps 16.

Without further analysis, the foregoing will so fully reveal the gist of the present invention that others can, by applying current knowledge, readily adapt it for various applications without omitting features, that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A cross connection link for electrically connecting a series of modular terminal blocks to the same electrical potential, comprising an elongated, electrically conductive member designed to span and define respective gaps with a plurality of spaced terminal blocks which are to be electrically connected with one another; an electrically conductive bridging member for each of the terminal blocks designed to bridge the gap between the respective terminal block and said elongated member, said bridging members being spaced from each other in longitudinal direction of said elongated member, and each of said bridging members being substantially L-shaped and including a first leg which projects from said elongated member and a second leg which extends from said first leg; a connecting member for each of said legs designed to connect the same with the respective terminal block; a retaining member for each of said connecting members; and mounting means for said retaining members, each of said retaining members receiving at least a portion of the respective connecting member to retain the same adjacent to the respective second leg.

2. A cross connection link as defined in claim 1, wherein said second legs are shorter than said first legs.

3. A cross connection link as defined in claim 1, wherein said connecting members comprise screws.

4. A cross connection link as defined in claim 1, wherein said first legs and said elongated member are of one piece and the junctions between said elongated member and said first legs are weakened.

5. A cross connection link as defined in claim 1, wherein said elongated member constitutes a grip for said connector.

6. A cross connection link as defined in claim 1, wherein said elongated member comprises a narrow strip of electrically conductive material.

7. A cross connection link as defined in claim 1, each of said connecting members comprising a head and a shank, and said heads having bearing faces in the regions of the intersections with said shanks; and wherein said bearing faces engage bearing areas of said second legs and said bearing areas are substantially planar.

8. A connector for electrically connecting a series of electrical elements, particularly a series of electrical clamps, with one another, comprising an elongated electrically conductive member designed to span and define respective gaps with a plurality of spaced electrical elements which are to be electrically connected with one another; an electrically conductive bridging member for each of the electrical elements designed to bridge the gap between the respective electrical element and said elongated member, said bridging members being spaced from each other in longitudinal direction of said elongated member, and each of said bridging members being substantially L-shaped and including a first leg which projects from said elongated member and a second leg which extends from said first leg; a connecting member for each of said second legs designed to connect the same with the respective electrical element; a retaining member for each of said connecting members; and a common mounting member for said retaining members, each of said retaining members receiving at least a portion of the respective connecting member to retain the same adjacent to the respective second leg.

9. A connector as defined in claim 8, wherein said mounting member is provided with slots designed to receive and loosely clamp dividing walls separating neighboring ones of the electrical elements.

10. A connector as defined in claim 8, wherein said retaining members and said mounting member are of one piece and the junctures between said mounting member and said retaining members are weakened.

11. A connector as defined in claim 8, wherein each of said retaining members is provided with an opening to permit tightening and loosening of said connecting members from externally of said retaining members.

12. A connector as defined in claim 11, wherein each of said openings is dimensioned so as to prevent passage of the respective connecting member therethrough.

13. A connector as defined in claim 11, wherein said openings are circular.

14. A connector as defined in claim 13, wherein said retaining members include portions which are remote from the second legs of the respective bridging members and said openings are located in said remote portions of the respective retaining members, each of said retaining members having a receiving space of substantially rectangular cross section for the respective connecting member, said receiving spaces communicating with the respective openings and being disposed between the respective openings and the second legs of the respective retaining members.

15. A connector as defined in claim 8, each of said first legs having a lower end remote from said elongated member, and said second legs extending from said lower ends; and wherein said mounting member is located above said connecting members and said retaining members project downwardly from said mounting member to embrace said portions of said connecting members.

16. A connector as defined in claim 15, wherein each of said retaining members comprises a sleeve having an open bottom end arranged to receive the respective connecting member, said sleeves also having upper edges via which said sleeves are suspended from said mounting member.

17. A connector as defined in claim 16, wherein said sleeves have substantially rectangular cross sections.

18. A connector as defined in claim 8, wherein said mounting member comprises an insulating jacket which receives at least part of said elongated member.

19. A connector as defined in claim 18, wherein said jacket and said elongated member are provided with a cooperating depression and protuberance for maintaining said elongated member and said jacket in a predetermined position relative to one another.

20. A connector as defined in claim 19, wherein said depression is formed in said elongated member and said protuberance is formed on said jacket.

* * * * *